US010113383B2

(12) United States Patent
Duong et al.

(10) Patent No.: US 10,113,383 B2
(45) Date of Patent: Oct. 30, 2018

(54) POSITIVE RETENTION LOCK RING FOR TUBING HANGER

(71) Applicant: Vetco Gray Inc., Houston, TX (US)

(72) Inventors: Khanh Anh Duong, Sugar Land, TX (US); Rick C. Hunter, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 552 days.

(21) Appl. No.: 14/540,775

(22) Filed: Nov. 13, 2014

(65) Prior Publication Data

US 2015/0068725 A1 Mar. 12, 2015

Related U.S. Application Data

(63) Continuation-in-part of application No. 13/468,378, filed on May 10, 2012.

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/03; E21B 23/02; E21B 43/10
See application file for complete search history.

(56) References Cited

U.S. PATENT DOCUMENTS 4,641,708 A * 2/1987 Wightman ..... E21B 33/043 166/208
4,697,828 A * 10/1987 Chou ..... E21B 33/04 285/123.4

(Continued)

FOREIGN PATENT DOCUMENTS

CN 2203355 Y 7/1995
CN 201448083 U 5/2010

(Continued)

OTHER PUBLICATIONS

Unofficial English translation of Office Action issued in connection with related CN Application No. 201310171100.6 dated May 31, 2016.

(Continued)

*Primary Examiner* — Brad Harcourt
*Assistant Examiner* — David Carroll
(74) *Attorney, Agent, or Firm* — Hogan Lovells US LLP

(57) ABSTRACT

A wellhead assembly includes a wellhead housing with a bore and an annular lock groove on an inner diameter surface of the bore. A wellbore member is concentrically located within the bore of the wellhead housing, defining an annulus between the wellbore member and the wellhead housing. An annular lock ring is positioned in the annulus. The annular lock ring has an outer diameter profile for engaging the lock groove and is radially expandable from an unset position to a set position. An energizing ring is positioned in the annulus to push the lock ring outward to the set position as the energizing ring moves downward. A retainer selectively engages the energizing ring and limits axial upward movement of the energizing ring relative to the wellbore member, retains the annular lock in the set position, and prevents axial upward movement of the wellbore member relative to the wellhead housing.

19 Claims, 5 Drawing Sheets

(56) References Cited

U.S. PATENT DOCUMENTS

| | | | | |
|---|---|---|---|---|
| 4,751,965 | A * | 6/1988 | Cassity | E21B 33/04 166/182 |
| 4,771,828 | A * | 9/1988 | Cassity | E21B 33/04 166/115 |
| 5,060,724 | A | 10/1991 | Brammer et al. | |
| 6,516,875 | B2 | 2/2003 | Reilly et al. | |
| 6,763,891 | B2 | 7/2004 | Humphrey et al. | |
| 7,963,336 | B2 | 6/2011 | Fraser et al. | |
| 2005/0284640 | A1 | 12/2005 | Borak, Jr. | |
| 2007/0169940 | A1 | 7/2007 | Fenton et al. | |
| 2013/0299193 | A1 | 11/2013 | Duong | |

FOREIGN PATENT DOCUMENTS

| | | | |
|---|---|---|---|
| CN | 201448086 | U | 5/2010 |
| CN | 201778732 | U | 3/2011 |
| GB | 780298 | A | 7/1957 |
| WO | 02084069 | A1 | 10/2002 |

OTHER PUBLICATIONS

GB Search and Examination Report dated Oct. 25, 2013, from corresponding Application No. GB1308232.6.

Search Report and Written Opinion issued in connection with corresponding Application No. PCT/US2015/060267 dated Feb. 11, 2016.

* cited by examiner

POSITIVE RETENTION LOCK RING FOR TUBING HANGER

CROSS REFERENCE TO RELATED APPLICATION

This application is a continuation-in-part of and claims priority to and the benefit of U.S. patent application Ser. No. 13/468,378, titled "Positive Retention Lock Ring for Tubing Hanger," filed May 10, 2012, the full disclosure of which is hereby incorporated herein by reference in its entirety for all purposes.

BACKGROUND OF THE DISCLOSURE

1. Field of the Disclosure

The present disclosure relates in general to mineral recovery wells, and in particular to lockdown rings for retaining wellbore members in a housing.

2. Brief Description of Related Art

Tubing hangers are landed on a shoulder in a wellhead. The shoulder prevents downward movement of the tubing hanger in the wellhead. The weight of the tubing hanger and the tubing hanging from the tubing hanger can prevent upward movement of the tubing hanger under some circumstances. A lockdown ring, however, is required to lock the tubing hanger in place when the tubing hanger is subjected to high pressures. Those high pressures can cause the tubing hanger to move axially upward.

Lockdown rings can be energized by an energizing ring. The energizing ring can have a tapered surface that expands the lockdown ring radially outward into a lockdown groove. The energizing ring can itself be moved axially downward by a seal ring. Once the energizing ring energizes the lockdown ring, the energizing ring stays in place to maintain the radial position of the lockdown ring. The seal ring, which actuated the energizing ring, can remain in position to hold the lockdown ring in place. Unfortunately, the seal may need to be removed from time to time. For example, the seal may need to be replaced. High pressure in the wellbore can cause the tubing hanger or the energizing ring to shift upward when the seal has been removed. The nature of the energizing ring, and the tapered surface on the energizing ring, means that any upward movement of the energizing ring can allow the lockdown ring to move radially inward, thus weakening the lock. Continued pressure, and force from the lockdown ring on the energizing ring, can be sufficient to move the lockdown ring from the set position to an unset position. It is desirable to retain the lockdown ring in the set position in spite of vertical movement of the energizing ring.

SUMMARY OF THE DISCLOSURE

Embodiments of this disclosure relate primarily to a tubing hanger lock ring that can be positively retained after a tubing hanger seal is set. Systems and methods of this disclosure can allow for changing the seal without compromising the locking capability of the tubing hanger to the wellhead. The lock ring can stay engaged even when the seal is removed.

In an embodiment of this disclosure, a wellhead assembly includes a wellhead housing. The wellhead housing has a bore with an axis and an annular lock groove on an inner diameter surface of the bore. A wellbore member is concentrically located within the bore of the wellhead housing, defining an annulus between the wellbore member and the wellhead housing. The wellbore member has an upward facing shoulder. An annular lock ring is positioned in the annulus. The annular lock ring has an outer diameter profile for engaging the lock groove and is radially expandable from an unset position to a set position. The set position prevents upward axial movement of the wellbore member relative to the wellhead housing. The lock ring has an inward and upward facing tapered surface. An energizing ring is positioned in the annulus above the lock ring. The energizing ring is axially movable from an upper position to a lower position, and has an outward and downward facing lower tapered surface that engages the tapered surface of the lock ring to push the lock ring outward to the set position as the energizing ring moves downward. A retainer is in selective engagement with the energizing ring. The retainer limits axial upward movement of the energizing ring relative to the wellbore member, retains the annular lock in the set position, and prevents axial upward movement of the wellbore member relative to the wellhead housing.

In an alternate embodiment of this disclosure, a wellhead assembly includes a wellhead housing, the wellhead housing having a bore with an axis and an annular lock groove on an inner diameter surface of the bore. A wellbore member is concentrically located within the bore of the wellhead housing defining an annulus between the wellbore member and the wellhead housing. The wellbore member has an upward facing shoulder. An annular lock ring is positioned in the annulus. The annular lock ring is located on the upward facing shoulder and has an outer diameter profile for engaging the lock groove. The annular lock ring is radially expandable from an unset position to a set position, the set position preventing upward axial movement of the wellbore member relative to the wellhead housing. The lock ring has an inward and upward facing tapered surface. An energizing ring is positioned in the annulus above the lock ring. The energizing ring is axially movable from an upper position to a lower position. The energizing ring has an outward and downward facing lower tapered surface that engages the upward facing tapered surface of the lock ring to push the lock ring outward to the set position as the energizing ring moves downward. A retainer is carried by the wellbore member. The retainer is biased radially outward and when the annular lock ring is in the set position, the energizing ring is retained between the upward facing shoulder of the wellbore member and the retainer, preventing axial upward movement of the wellbore member relative to the wellhead housing.

In yet another alternate embodiment of this disclosure, a method for securing a wellbore member in a bore of a wellhead housing includes providing an annular lock groove on an inner diameter surface of the bore of the wellhead housing. The wellbore member is positioned concentrically within the bore of the wellhead housing, the wellbore member and the wellhead housing defining an annulus therebetween. The wellbore member carries a radially outward biased retainer. An annular lock ring is positioned in the annulus, the lock ring having an inward and upward facing tapered surface. An energizing ring is positioned in the annulus above the lock ring, the energizing ring having a downward facing lower tapered surface. The energizing ring is moved downward so that the downward facing lower tapered surface pushes the lock ring outward to a set position where the lock ring engages the lock groove and the retainer is located axially above a top surface of the energizing ring, limiting axial upward movement of the energizing ring relative to the wellbore member.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
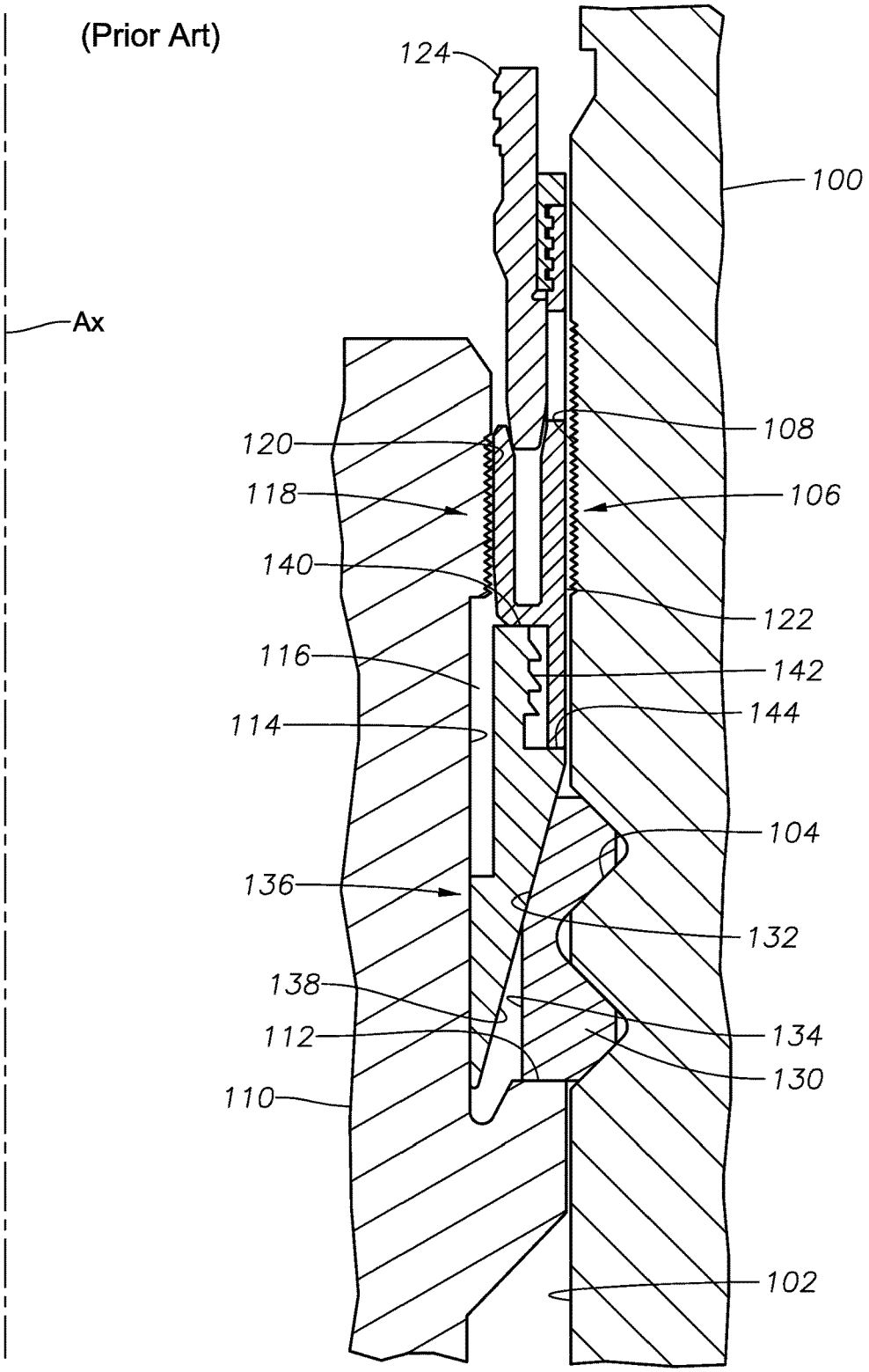
FIG. 1 (Prior Art)
FIG. 1 is a sectional side view of a conventional energizing ring and lockdown ring in a wellhead housing.

Referring to FIG. 1, a wellhead housing 100 is shown. Wellhead housing 100 has a bore 102 with a central axis Ax. Annular lock ring groove 104 is located on an inner diameter surface of the bore 102. Lock ring groove 104 can include one or more annular grooves to define a lock ring groove profile. The individual grooves can each have the same shape or can have a different shape. In the embodiment shown in FIG. 1, the individual grooves each include angled surfaces that converge toward each other as the outer diameter ("OD") of the groove becomes larger to create generally a "V" shaped profile for each individual groove. Sealing surface 106 can also be located on the inner diameter surface of bore 102. In some embodiments, sealing surface 106 can include wickers 108.

A wellbore member, such as casing or tubing hanger 110 is concentrically located within bore 102 of wellhead housing 100. Tubing hanger 110 can have an upward facing shoulder 112 and a sidewall 114. Sidewall 114 can have an outer diameter ("OD") than is smaller than the OD of upward facing shoulder 112. An annulus 116 is located between sidewall 114 and bore 102. Sealing surface 118 can be located above sidewall 114. The OD of sidewall 114 can be less than the OD of sealing surface 118, so that sidewall 114 is an elongated groove on the outer diameter of tubing hanger 110. In embodiments, sealing surface 118 can include wickers 120, as shown in FIG. 1. An annular seal, such as seal ring 122 can be positioned in annulus 116 to form a seal between sealing surface 106 and sealing surface 118. Any type of annular seal can be used including, for example, u-shaped, H-shaped, and elastomeric seals. Seal energizing ring 124 can be used to energize seal ring 122.

Lock ring 130, which is conventional, can be positioned in annulus 116 to axially secure tubing hanger 110 to wellhead housing 100. Lock ring 130 can be a radially expandable ring. For example, it can be a split ring that, in its relaxed state, does not engage lock ring groove 104. Lock ring 130 can be radially expanded until it engages lock ring groove 104. Lock ring 130 can have an outer diameter profile that generally corresponds to the profile of annular lock ring groove 104. In some embodiments, outer diameter profile can have upper and lower tapered legs that converge toward a point. The upper and lower tapered legs can engage the tapers of lock ring groove 104 to cause lock ring 130 to be axially aligned with lock ring groove 104 when lock ring 130 is radially expanded into lock ring groove 104. Lock ring 130 can have an upward facing tapered surface 132 on an inner diameter. Cylindrical surface 134 can be located below upward facing tapered surface 132.

A wedge ring, such as energizing ring 136, is a conventional wedge ring that can be used to radially expand lock ring 130 into lock ring groove 104. Energizing ring 136 has a downward facing tapered surface 138 on an outer diameter. Downward facing tapered surface 138 can taper at the same angle as upward facing tapered surface 132 of lock ring 130. An upper end of energizing ring 136 can include an upward facing top surface 140 and retrieval ridges 142. Other upward facing surfaces, such as shoulder 144, can be located on energizing ring 136. Retrieval ridges 142 can be circumferentially extending ridges on an outer diameter surface. A retrieval tool (not shown) can engage retrieval ridges 142 and use them as a gripping surface to withdraw energizing ring 136.

Energizing ring 136 can be urged downward into the inner diameter of lock ring 130. As energizing ring 136 moves downward, downward facing tapered surface 138 can slidingly engage upward facing tapered surface 132 of lock ring 130. Continued downward movement of energizing ring, relative to lock ring 130, causes lock ring 130 to expand radially outward to engage lock ring groove 104. Lock ring 130 is in an "unset position" when it is not engaged in lock ring groove 104, and is in a "set position" when it is fully expanded into lock ring groove 104. A running tool or a lower end of seal ring 122 can be used to engage an upward facing top surface 140 or shoulder 144 to urge energizing ring 136 downward. When seal ring 122 is set in place, a lower surface of seal ring 122 can engage an upper surface of energizing ring 136 to prevent upward movement of energizing ring 136. Unfortunately, seal ring 122 may need to be removed from time to time. For example, seal ring 122 may need to be replaced due to a leak, or may need to be replaced with a seal that can withstand a different amount of pressure. During the time that seal ring 122 is not in annulus 116, energizing ring 136 is not restrained against upward axial movement. Inward radial force from lock ring 130 can be transferred to energizing ring 136 and, due the interface of upward facing tapered surface 132 and downward facing tapered surface 138, that force from lock ring 130 can become axial force that urges energizing ring 136 upward. Furthermore, any axial movement of tubing hanger 110 relative to wellhead housing 100 can cause energizing ring 136 to move upward relative to lock ring 130. As energizing ring 136 moves upward, lock ring 130 is able to move inward from the set position toward the unset position. Once lock ring 130 reaches the unset position, tubing hanger 110 is able to move upward relative to wellhead housing 100.

Figure 2:
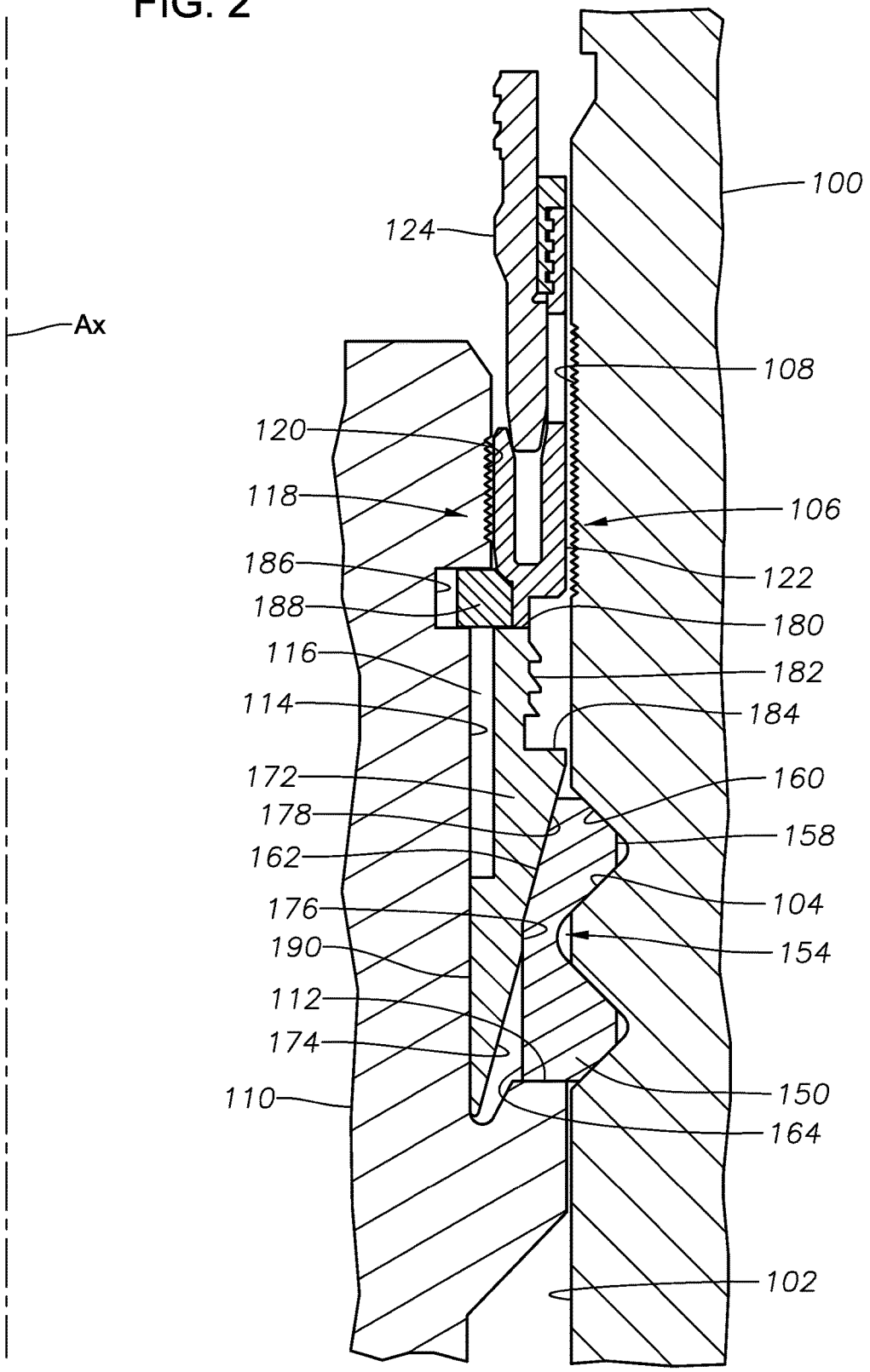
FIG. 2 is a sectional side view of an energizing ring and a lock ring with a retainer in accordance with an embodiment of this disclosure, shown in a set position in a wellhead housing.
Figure 5:
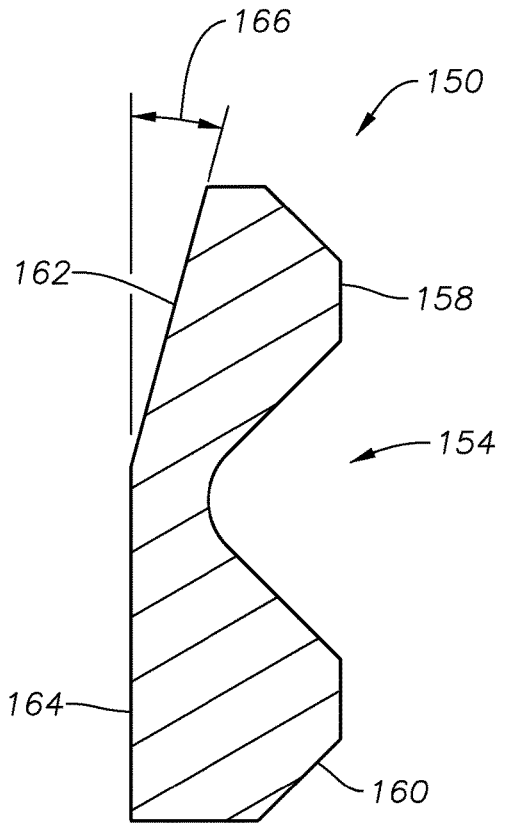
FIG. 5 is a sectional side view of the lock ring of FIG. 2.

Referring to FIGS. 2 and 5, in an embodiment of a positive retention lock ring for a tubing hanger seal, a lock ring 150 can be used to lock tubing hanger 110 (FIG. 2) in place. In embodiments, lock ring 150 can be an annular lock ring having an outer diameter profile 154 that generally corresponds to the profile of annular lock ring groove 104 for engaging lock ring groove 104 (FIG. 2). Lock ring 150 can be a radially expandable ring. In some embodiments, lock ring 150 can have a smaller diameter in its relaxed state and can be expanded to have a larger diameter. For example, it can be a split ring that, in its relaxed state, does not engage lock ring groove 104, and it can be radially expanded until it engages lock ring groove 104. In some embodiments, outer diameter profile 154 can have one or more ridges 158 that can engage the tapers 160 (FIG. 2) of lock ring groove 104 to cause lock ring 150 to be axially aligned with lock ring groove 104 when lock ring 150 is radially expanded into lock ring groove 104. Lock ring 150 can have an upward facing tapered surface 162 on an inner diameter. Cylindrical surface 164 can be located below upward facing tapered surface 162. The inner diameter sidewall of cylindrical surface 164 can be parallel to the axis of lock ring 150. The inner diameter of upward facing tapered surface 162 increases when moving axially upward away from the intersection with cylindrical surface 164. The lock ring taper angle 166 is the angle at which tapered surface 162 diverges from the axis of lock ring 150.

Figure 6:
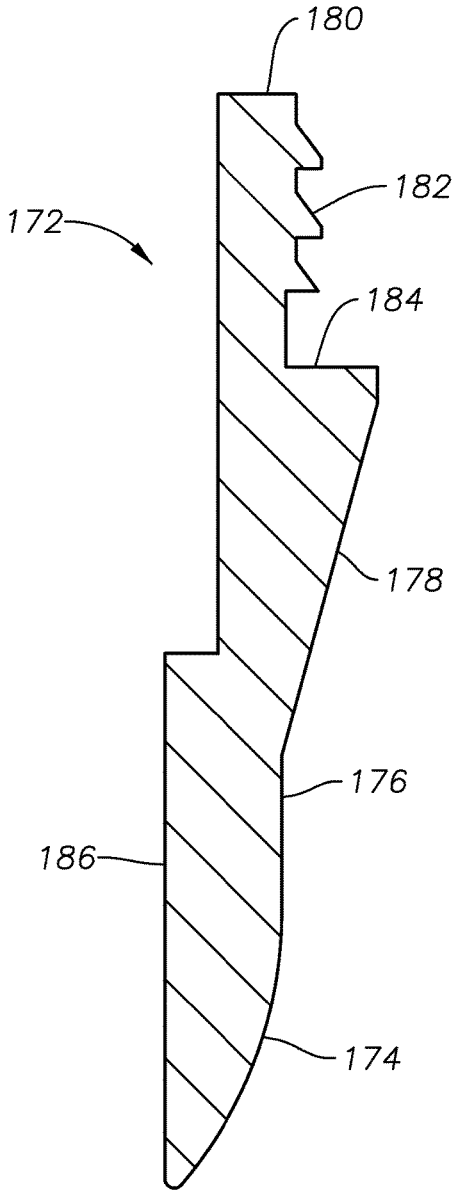
FIG. 6 is a sectional side view of the energizing ring of FIG. 2.

Referring to FIGS. 2 and 6, energizing ring 172 is an annular ring that can be used to expand locking ring 150. In embodiments, energizing ring 172 has an outward and downward facing lower tapered surface 174. In certain embodiments, such as the embodiment of FIG. 2, the angle of lower tapered surface 174, relative to the axis of energizing ring 172, can be the same as lock ring taper angle 166. In alternate embodiments, such as the embodiment of FIG. 6, the angle of lower tapered surface 174 can be different than lock ring taper angle 166, or can be curved, or can be a combination of angled surface and curved surface. Cylindrical surface 176 can be an OD surface extending upward from lower tapered surface 174. Lower tapered surface 174 can transition into cylindrical surface 176, so that the outer diameter of cylindrical surface 176 can equal the largest outer diameter of lower tapered surface 174. Furthermore, the outer diameter of cylindrical surface 176 can be equal to the inner diameter of cylindrical surface 164 of lock ring 150 when lock ring 150 is in the set position within lock ring groove 104 (FIG. 2). In some embodiments, an upper tapered surface 178 can face downward and outward, and extend upward from cylindrical surface 176 on energizing ring 172. In embodiments, the upper tapered surface 178 and the lower tapered surface 174 can incline at the same angle relative to the axis of energizing ring 172. In other embodiments, upper tapered surface 178 and the lower tapered surface 174 can incline at different angles relative to the axis of energizing ring 172. In some embodiments, the cylindrical surface 176 on the energizing ring 172 has an axial length that is less than an axial length of each of the upper tapered surface 178 and lower tapered surface 174. In other embodiments, the cylindrical surface 176 on the energizing ring 172 has an axial length that is greater than an axial length of one or both of the upper tapered surface 178 and lower tapered surface 174.

An upper end of energizing ring 172 can include an upward facing top surface 180 and retrieval ridges 182. Other upward facing surfaces, such as shoulder 184, can be located on energizing ring 172. Retrieval ridges 182 can be circumferentially extending ridges on an outer diameter surface. A retrieval tool (not shown) can engage retrieval ridges 182 and use them as a gripping surface to withdraw energizing ring 172.

Looking now at FIG. 2, tubing hanger 110 can include recess 186. In certain embodiments, recess 186 is an annular recess located on sidewall 114. In alternate embodiments, recess 186 can consist of a plurality of individual recesses located around the outer diameter of sidewall 114. Recess 186 can be located at a junction of sidewall 114 and sealing surface 118 so that a top surface of recess 186 has a greater radial depth, measured from sealing surface 118 to an inner diameter of recess 186, than a bottom surface of recess 186, measured from sidewall 114 to the inner diameter of recess 186.

Retainer 188 is associated with, and carried by, tubing hanger 110 and can be located within recess 186. Retainer 188 can be, for example, a ring shaped c-ring, a snap retainer, or other radially outward biased member. Retainer 188 has a radial depth that is greater than the radial depth of recess 186, measured from sidewall 114 to the inner diameter of recess 186, so that an outer diameter portion of retainer 188 extends outside of recess 186. Looking at FIG. 3, when lock ring 130 is in an unset position, an outer diameter of retainer 188 engages an inner diameter surface of energizing ring 172. Retainer 188 is located axially above a lower upward facing annular shoulder 192 located on an inner diameter of energizing ring 172 so that energizing ring 172 cannot move axially upward past retainer 188. In such a position, retainer 188 can assist with maintaining energizing ring 172 and lock ring 130 with tubing hanger 110 as tubing hanger 110 is lowered into wellhead housing 100.

Continuing to look at FIG. 2, as lock ring 150 is being energized by downward movement of energizing ring 172 relative to lock ring 150, a top end of energizing ring 172 will pass a bottom surface of retainer 188. With the inner diameter surface of energizing ring 172 no longer impeding radially outward movement of retainer 188, retainer 188 will expand or otherwise move radially outward so that the bottom surface of retainer 188 passes over a portion of top surface 180 of energizing ring 172. Looking now at FIG. 4, with retainer 188 moved radially outward over a portion of top surface 180 of energizing ring 172, energizing ring 172 cannot move axially upward relative to tubing hanger 110 and lock ring 150 will remain in engagement with lock ring groove 104, seal ring 122 and seal energizing ring 124 are removed. When the retrieval tool (not shown) engages retrieval ridges 182 of energizing ring 172, the retrieval tool can move retainer 188 back into recess 186 so that lock ring 150 can move back to an unset position.

In alternate embodiments, retainer 188 can be individual outwardly biased segments. In other alternate embodiments, retainer 188 can instead be a raised bump on tubing hanger 110 or on energizing ring 172. The raised bump can engage a groove on the other of the tubing hanger 110 or on energizing ring 172 when lock ring 150 is in the engaged position, to prevent axially upward movement of energizing ring 172 relative to tubing hanger 110.

Figure 3:
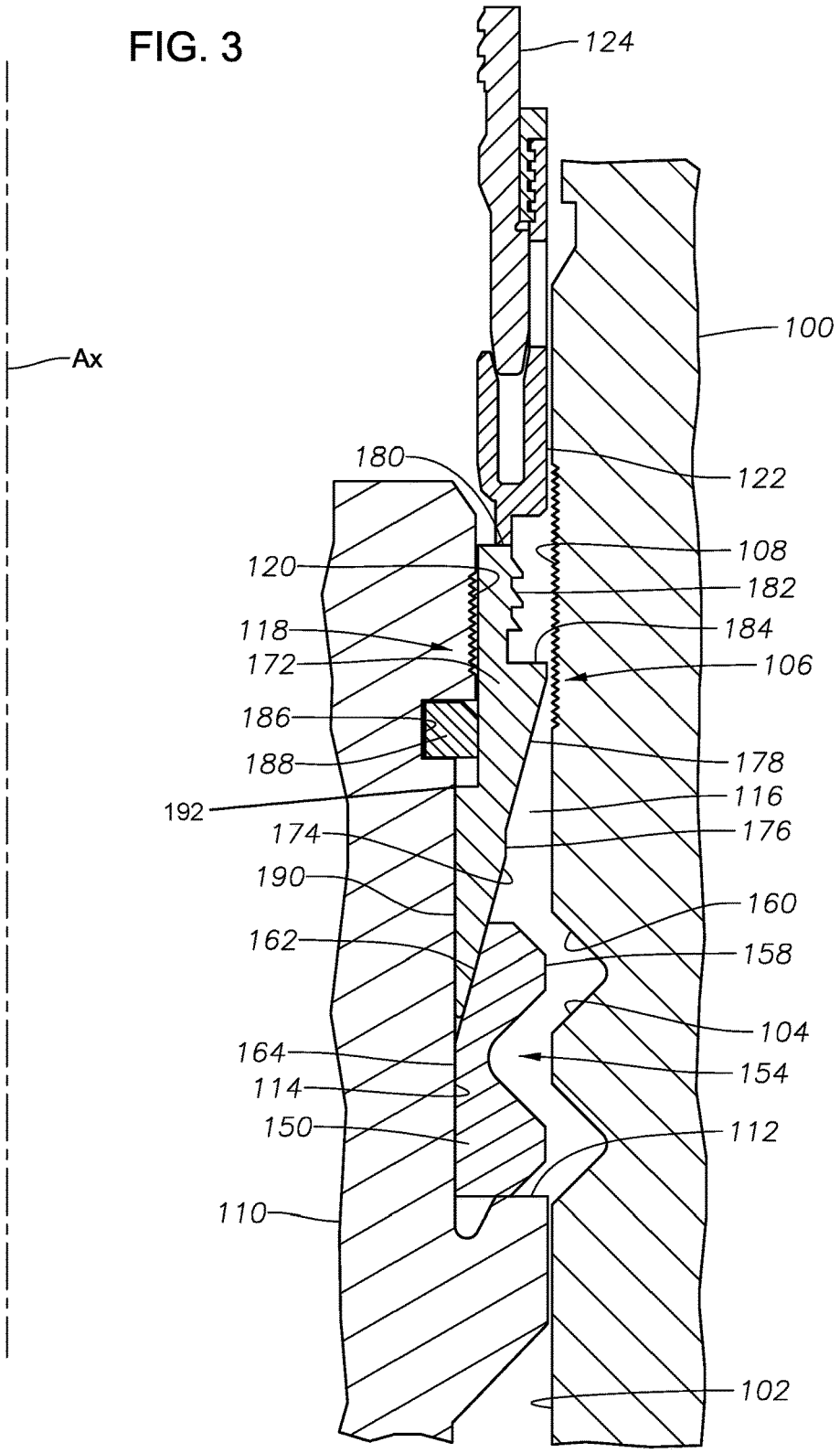
FIG. 3 is a sectional side view of the energizing ring, lock ring, and retainer of FIG. 2, shown in an unset position in a wellhead housing.
Figure 4:
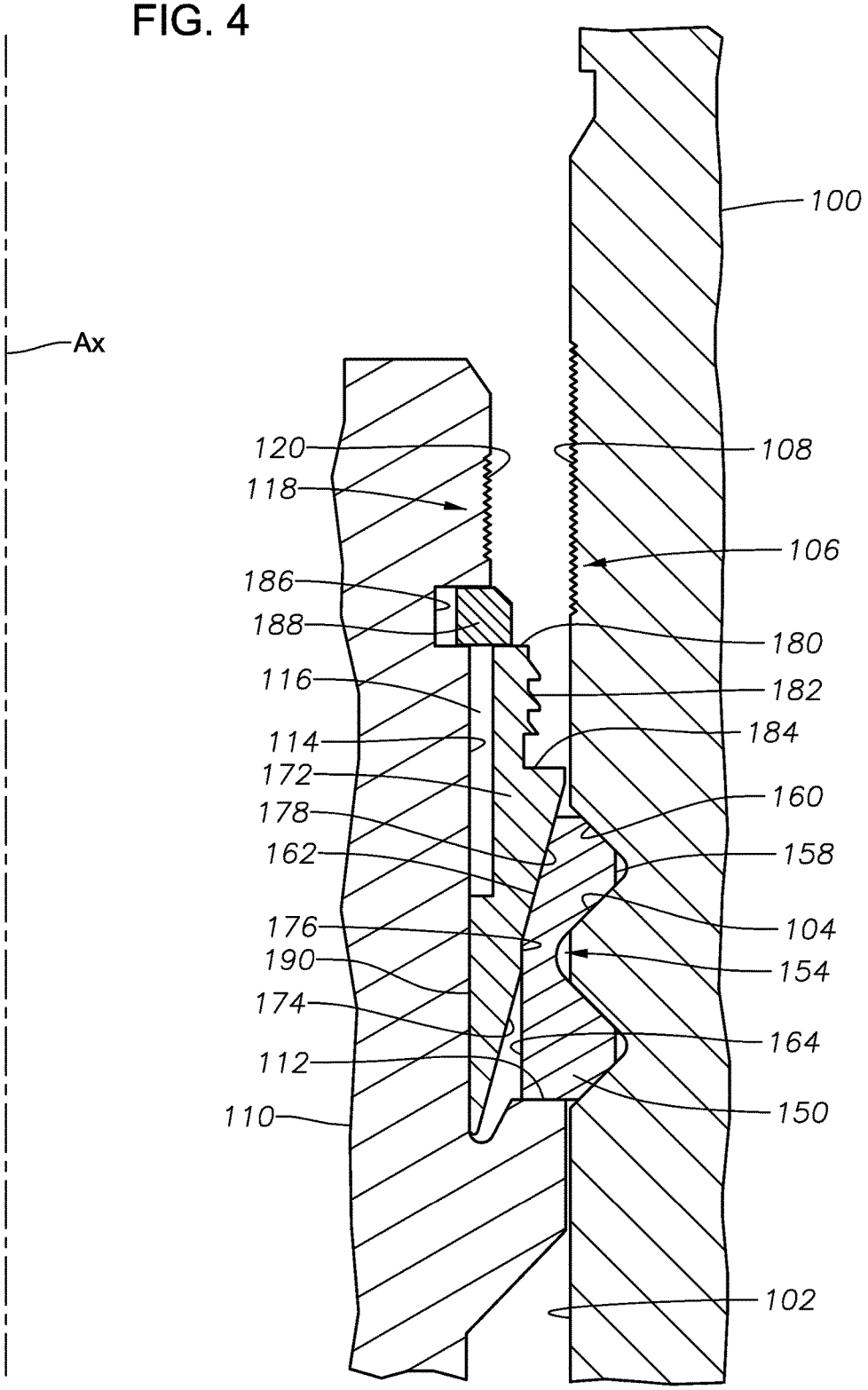
FIG. 4 is a sectional side view of the energizing ring, lock ring, and retainer of FIG. 2 shown in a set position in a wellhead housing with the sealing ring removed.

Referring to FIGS. 2-4, an embodiment of a positive retention lockdown system is shown in an unset position (FIG. 3), a set position (FIG. 2), and a position wherein energizing ring 172 has shifted but lock ring 150 remains in the set position (FIG. 4). As shown in FIG. 3, tubing hanger 110 is landed in wellhead housing 100 and does not move downward relative to wellhead housing 100. Lock ring 150 is not expanded. The inner diameter of lock ring 150, thus, is equal to or slightly greater than the outer diameter of sidewall 114. In embodiments, the ID of lock ring 150 in its relaxed state can be smaller than the OD of sidewall 114 so that lock ring 150 is partially expanded when installed on tubing hanger 110 and in the unset position. In the unset position, the largest OD of lock ring 150 is less than the ID of bore 102 so that tubing hanger 110 can be run in with lock ring 150 in position on sidewall 114.

In the unset position, energizing ring 172 is located above lock ring 150. The smallest inner diameter 190 of energizing ring 172 is the same or slightly larger than the outer diameter of sidewall 114 so that energizing ring 172 can slide axially along sidewall 114. In the unset position, lower tapered surface 174 can be above or in contact with upward facing tapered surface 162. In the unset position, retainer 188 is located adjacent to, and engages, the inner diameter surface of energizing ring 172 so that retainer 188 is pushed radially inward into recess 186.

Seal ring 122 can be positioned above energizing ring 172 so that downward movement of seal ring 122 causes a lower surface of seal ring 122 to contact energizing ring 172. Seal ring 122 can contact, for example, top surface 180. Downward movement of seal ring 122 will, thus, urge energizing ring 172 axially downward. Seal energizing ring 124 can be used to urge seal ring 122 downward. As one of skill in the art will appreciate, in some embodiments, seal energizing ring 124 can urge seal ring 122 downward before energizing seal ring 122. When seal ring 122 resists downward movement with a sufficient amount of force, seal energizing ring 124 will then energize seal ring 122. Seal ring 122 will resist downward movement, for example, when downward movement of energizing ring 172 is stopped by upward facing shoulder 112. Because seal ring 122 is in contact with, or connected to, energizing ring 172, the downward movement of seal ring 122 is stopped when energizing ring 172 can no longer move downward. In some embodiments, a running tool (not shown) can be used to urge energizing ring 172 downward into engagement with lock ring 150. In these embodiments, seal ring 122 is not required to urge energizing ring 172 downward.

Referring to FIG. 5, when energizing ring 172 moves downward, from an upper position to a lower position, lower tapered surface 174 slidingly engages tapered surface 162 of lock ring 150 to cause lock ring 150 to expand radially outward. Upward facing shoulder 112, of tubing hanger 110, prevents lock ring 150 from moving axially downward. Lock ring 150 expands radially outward into lock ring groove 104 until lower tapered surface 174 reaches a point axially below the lowermost edge of tapered surface 162. In some embodiments, lower tapered surface 174 of energizing ring 172 is spaced below the tapered surface 162 of the lock ring 150 while the lock ring 150 is in the set position. In some embodiments, the lower tapered surface 174 of the energizing ring 172 is free of engagement with the lock ring 150 while the lock ring 150 is in the set position.

Lock ring 150 is in the set position when it engages lock ring groove 104. The cylindrical surface 176 on the energizing ring 172 is positioned so that a lower end of the cylindrical surface on the energizing ring 172 will contact an upper end of the cylindrical surface 164 on the lock ring 150 when the lock ring 150 has fully engaged the lock ring groove 104.

After lower tapered surface 174 clears tapered surface 162, cylindrical surface 176 can slidingly engage cylindrical surface 164 as energizing ring 172 moves downward relative to wellhead housing 100. Cylindrical surface 176, thus, retains lock ring 150 in the expanded, or set, position. In some embodiments, energizing ring can continue moving downward until upper tapered surface 178 contacts tapered surface 162. In some embodiments, where there is additional room in lock ring groove 104 for lock ring 150 to expand, upper tapered surface 178 can engage tapered surface 162 to cause further expansion of lock ring 150. Downward movement of energizing ring 172 is stopped when energizing ring 172 lands on upward facing shoulder 112 or when lock ring 150 can not further expand to allow upper tapered surface 178 to move downward.

During the downward movement of energizing ring 172, retainer 188 is prevented from moving radially outward by an inner diameter surface of energizing ring 172, until lock ring 150 is in the set position. With lock ring 150 in the set position, retainer 188 is clear of the inner diameter surface of energizing ring 172. Retainer 188 with therefore have expanded or moved radially outward to be located axially over a portion of top surface 180 of energizing ring 172, preventing upward axial movement of energizing ring 172 relative to tubing hanger 110.

With lock ring 150 in the set position, seal ring 122 can be energized by continued downward force from seal energizing ring 124. With seal ring 122 energized, seal ring 122 can also retain energizing ring 172 to prevent it from moving upward. Energizing ring 172, thus, can maintain lock ring 150 in the set position. Referring now to FIG. 6, when seal ring 122 (FIG. 5) is removed, energizing ring 172 is no longer held in place against upward axial force by seal ring 122.

Cylindrical surface 176 can additionally resist inward movement of lock ring 150 by continuing to engage cylindrical surface 164 of lock ring 150. Indeed, energizing ring 172 can move axially upward, relative to wellhead housing 100 and lock ring 150, by as much as a predetermined distance without permitting any radial movement of lock ring 150. In some embodiments, that distance is slightly less than or equal to the axial length of cylindrical surface 176 before lock ring 150 begins to move from the set position toward the unset position. Therefore in certain embodiments, retainer 188 can be spaced a distance axially above top surface 180 of energizing ring 172. If retainer 188 fails to engage lock ring 150, lock ring 150 will still remain in the set position due to the frictional forces between cylindrical surface 164 and the inner diameter surface lock ring 150. Alternately, in other embodiments, retainer 188 can be omitted and lock ring 150 can remain in the set position due to the frictional forces between cylindrical surface 164 and the inner diameter surface lock ring 150.

While the invention has been shown or described in only some of its forms, it should be apparent to those skilled in the art that it is not so limited, but is susceptible to various changes without departing from the scope of the invention.

What is claimed is:

1. A wellhead assembly comprising:

a wellhead housing, the wellhead housing having a bore with an axis and an annular lock groove on an inner diameter surface of the bore;

a wellbore member concentrically located within the bore of the wellhead housing defining an annulus between the wellbore member and the wellhead housing, the wellbore member having an upward facing shoulder;

an annular lock ring positioned in the annulus, the annular lock ring having an outer diameter profile for engaging the lock groove and being radially expandable from an unset position to a set position, the set position preventing upward axial movement of the wellbore member relative to the wellhead housing, the lock ring having an inward and upward facing tapered surface;

an energizing ring positioned in the annulus above the lock ring, the energizing ring being axially movable from an upper position to a lower position, the energizing ring having an outward and downward facing lower tapered surface that engages the upward facing tapered surface of the lock ring to push the lock ring outward to the set position as the energizing ring moves downward; and a retainer in selective engagement with the energizing ring, the retainer engaging a top surface of the energizing ring when the energizing ring is in the lower position, retaining the annular lock ring in the set position and limiting axial upward movement of the energizing ring relative to the wellbore member, the retainer engaging a lower upward facing annular shoulder of the energizing ring when the energizing ring is in the upper position, limiting axial movement of the energizing ring via the lower upward facing annular shoulder, and retaining the annular lock ring and the energizing ring with the wellbore member when the annular lock ring is in the unset position.

2. The wellhead assembly according to claim 1, wherein the retainer is biased radially outward so that when the lock ring is in the set position, the retainer engages the top surface of the energizing ring.

3. The wellhead assembly according to claim 1, wherein the retainer is located within a recess of the wellbore member.

4. The wellhead assembly according to claim 1, wherein the annular lock ring is positioned on the upward facing shoulder and the energizing ring is retained between the upward facing shoulder and the retainer.

5. The wellhead assembly according to claim 1, wherein the annular lock ring has a cylindrical surface extending downward from the upward facing tapered surface of the annular lock ring, and the energizing ring has a cylindrical surface extending upward from the lower tapered surface and engaging the cylindrical surface on the lock ring when the lock ring is in the set position, wherein while the energizing ring is in the set position, the energizing ring can move a predetermined axial distance relative to the lock ring without permitting any radial movement of the annular lock ring.

6. The wellhead assembly according to claim 1, wherein the lower tapered surface of the energizing ring is spaced below the upward facing tapered surface of the lock ring while the lock ring is in the set position and wherein the lower tapered surface of the energizing ring is free of engagement with the lock ring while the lock ring is in the set position.

7. The wellhead assembly according to claim 1, wherein the energizing ring further comprises an upper tapered surface, the upper tapered surface engaging the upward facing tapered surface on the lock ring while the lock ring is in the set position.

8. The wellhead assembly according to claim 7, wherein the energizing ring has a cylindrical surface extending upward from the lower tapered surface wherein the cylindrical surface on the energizing ring has an axial length that is less than an axial length of each of the upper and lower tapered surfaces.

9. The wellhead assembly according to claim 1, further comprising an annular seal located above the energizing ring, wherein downward movement of the annular seal, relative to the wellhead housing, causes the energizing ring to move downward relative to the lock ring.

10. A wellhead assembly comprising:

a wellhead housing, the wellhead housing having a bore with an axis and an annular lock groove on an inner diameter surface of the bore;

a wellbore member concentrically located within the bore of the wellhead housing defining an annulus between the wellbore member and the wellhead housing, the wellbore member having an upward facing shoulder;

an annular lock ring positioned in the annulus, the annular lock ring located on the upward facing shoulder and having an outer diameter profile for engaging the lock groove and being radially expandable from an unset position to a set position, the set position preventing upward axial movement of the wellbore member relative to the wellhead housing, the lock ring having an inward and upward facing tapered surface;

an energizing ring positioned in the annulus above the lock ring, the energizing ring being axially movable from an upper position to a lower position, the energizing ring having an outward and downward facing lower tapered surface that engages the upward facing tapered surface of the lock ring to push the lock ring outward to the set position as the energizing ring moves downward; and a retainer located within a recess of the wellbore member, the retainer engaging a lower upward facing annular shoulder of the energizing ring in the upper position and retaining the energizing ring and the annular lock ring with the wellbore member when the annular lock ring is in the unset position, the retainer engaging a top surface of the energizing ring in the lower position, wherein the retainer is biased radially outward, retaining the energizing ring between the upward facing shoulder of the wellbore member and the retainer, preventing axial upward movement of the wellbore member relative to the wellhead housing and retaining the annular lock ring in the set position.

11. The wellhead assembly according to claim 10, further comprising further an annular seal located above the energizing ring, wherein downward movement of the annular seal, relative to the wellhead housing, causes the energizing ring to move downward relative to the lock ring and to the lower position.

12. The wellhead assembly according to claim 10, wherein the energizing ring further comprises an upper tapered surface extending downward and outward, the upper tapered surface engaging the upward facing tapered surface on the lock ring while the lock ring is in the set position, and wherein the upper tapered surface and a portion of the lower tapered surfaces incline at a same angle relative to the axis.

13. The wellhead assembly according to claim 10, wherein:

the lock ring has a cylindrical surface extending downward from the upward facing tapered surface; and the energizing ring has a cylindrical surface extending upward from the lower tapered surface and engaging the cylindrical surface on the lock ring when the lock ring is in the set position, wherein while the energizing ring is in the set position, the energizing ring can move a predetermined axial distance relative to the lock ring without permitting any radial movement of the annular lock ring and the lower tapered surface of the energizing ring is free of engagement with the lock ring while the lock ring is in the set position.

14. The wellhead assembly according to claim 13, wherein the lower tapered surface of the energizing ring slides against the upward facing tapered surface of the lock ring while the energizing ring is moving downward until the lock ring engages the lock groove, at which point the cylindrical surface of the energizing ring contacts the cylindrical surface of the lock ring, and continued downward movement of the energizing ring causes the cylindrical surface of the energizing ring to slide downwardly on the cylindrical surface of the lock ring.

15. A method for securing a wellbore member in a bore of a wellhead housing, the method comprising:

(a) providing an annular lock groove on an inner diameter surface of the bore of the wellhead housing;

(b) positioning the wellbore member concentrically within the bore of the wellhead housing, the wellbore member and the wellhead housing defining an annulus therebetween, the wellbore member carrying a radially outward biased retainer;

(c) positioning an annular lock ring in the annulus, the lock ring having an inward and upward facing tapered surface;

(d) positioning an energizing ring in the annulus above the lock ring, the energizing ring having a downward facing lower tapered surface, a lower upward facing annular shoulder of the energizing ring abutting the retainer, the retainer retaining the energizing ring and the annular lock with the wellbore member via the lower upward facing annular shoulder when the annular lock ring is in an unset position; and (e) moving the energizing ring downward so that the downward facing lower tapered surface pushes the lock ring outward to a set position where the lock ring engages the lock groove and the retainer moving axially inward to a location axially above a top surface of the energizing ring, the top surface abutting the retainer, the retainer limiting axial upward movement of the energizing ring relative to the wellbore member, retaining the annular lock ring in the set position and preventing axial upward movement of the wellbore member relative to the wellhead housing.

16. The method according to claim 15, wherein the retainer is located within a recess of the wellbore member, and wherein the step of moving the energizing ring downward includes preventing the retainer from moving radially outward with an inner diameter surface of the energizing ring until the lock ring is in the set position.

17. The method according to claim 15, wherein step (e) includes moving the energizing ring downward until the downward facing lower tapered surface is below the upward facing tapered surface of the lock ring.

18. The method according to claim 15, wherein step (c) includes positioning the annular lock ring on an upward facing shoulder of the wellbore member, the method further comprising retaining the energizing ring between the upward facing shoulder and the retainer.

19. The method according to claim 15, wherein step (e) includes providing an annular seal above the energizing ring in the annulus, and wherein downward movement of the annular seal causes the energizing ring to move downward, the method further comprising after step (e), removing the annular seal and maintaining the lock ring in the set position with the retainer.

* * * * *